US008317447B2

(12) United States Patent
Jin

(10) Patent No.: US 8,317,447 B2
(45) Date of Patent: Nov. 27, 2012

(54) COMBINATION HOLE PUNCHING AND BOOK BINDING MACHINE

(75) Inventor: Lixing Jin, Hangzhou (CN)

(73) Assignees: Hangzhou Supu Business Machine Co., Ltd., Hangzhou (CN); Supu Group Inc., New York ( * ) Notice: Subject to any disclaimer, the term of this patent is extended or adjusted under 35 U.S.C. 154(b) by 129 days.

(21) Appl. No.: 12/721,766

(22) Filed: Mar. 11, 2010

(65) Prior Publication Data

US 2010/0166526 A1 Jul. 1, 2010

Related U.S. Application Data

(63) Continuation of application No. PCT/CN2007/003305, filed on Nov. 22, 2007.

(30) Foreign Application Priority Data

Sep. 11, 2007 (CN) ..... 2007 1 0071279

(51) Int. Cl.

| | |
|---|---|
| ***B42B 9/00*** | (2006.01) |
| ***B42B 5/08*** | (2006.01) |
| ***B42B 5/10*** | (2006.01) |
| ***B26D 5/08*** | (2006.01) |
| ***B26F 1/14*** | (2006.01) |

(52) U.S. Cl. ..... 412/38; 412/16; 412/39; 412/40; 83/549; 83/550; 83/551; 83/687; 83/691

(58) Field of Classification Search ..... 412/6–7, 412/16, 38–40; 83/549–551, 687, 691
See application file for complete search history.

(56) References Cited

U.S. PATENT DOCUMENTS

| | | | | |
|---|---|---|---|---|
| 4,872,796 | A * | 10/1989 | Hsieh et al. | 412/40 |
| 5,487,634 | A * | 1/1996 | Vercillo | 412/38 |
| 5,527,142 | A * | 6/1996 | Chih-Kwo | 412/38 |
| 6,079,924 | A * | 6/2000 | Chiang | 412/39 |
| 6,471,458 | B1 * | 10/2002 | Soule | 412/38 |
| 6,651,540 | B2 * | 11/2003 | Whiteman et al. | 83/687 |
| 7,255,032 | B2 * | 8/2007 | Ho | 83/691 |
| 7,270,042 | B2 * | 9/2007 | Mori et al. | 83/684 |

* cited by examiner

*Primary Examiner* — Dana Ross
*Assistant Examiner* — Kyle Grabowski
(74) *Attorney, Agent, or Firm* — Matthias Scholl P.C.; Matthias Scholl

(57) ABSTRACT

A combination hole punching and book binding machine having a worktable and an electric motor disposed fixedly thereon, a left changeover panel and a right changeover panel being symmetrically disposed on the worktable, a press knife assembly being disposed between the left changeover panel and the right changeover panel. By driving the left changeover panel and the right changeover panel, the press knife assembly can be combined as needed. Meanwhile, the quantity of the press knives is regulated, and thereby the number, pass, and pitch of holes is adjusted.

4 Claims, 4 Drawing Sheets

COMBINATION HOLE PUNCHING AND BOOK BINDING MACHINE

CROSS-REFERENCE TO RELATED APPLICATIONS

This application is a continuation of International Patent Application No. PCT/CN007/003305 with an international filing date of Nov. 22, 2007, designating the United States, now pending, and further claims priority benefits to Chinese Patent Application No. 200710071279.2 filed Sep. 11, 2007. The contents of all of the aforementioned applications, including any intervening amendments thereto, are incorporated herein by reference.

BACKGROUND OF THE INVENTION

1. Field of the Invention

The invention relates to a punching bookbinding machine, and more particularly to a combined punching bookbinding machine having capacity of adjusting pass or pitch of holes.

2. Description of the Related Art

Conventional punching bookbinding machines often have less than two kinds of press knife assembly and thereby the punching and binding mode is very limited. Although the punching and binding mode can be modified by disassembling and replacing a knife mould, the storage and maintenance is difficult and a skilled operator required, which results in high cost. Furthermore, different country has different requirement on paper size and punching amount, but the machine cannot achieve the purpose flexibly. Chinese Patent No. 200520015524.4 discloses a punching bookbinding machine having a plurality of press knife and corresponding knife-pressing sheet metal thereof. To reduce the punching amount, a knife-pressing sheet metal is withdrawn, and so the corresponding press knife cannot work. Although the punching bookbinding machine can punch selectively, the pitch of holes and binding mode cannot be adjustable. Currently, there is a punching bookbinding machine having different press knife assembly at each end. However, two kinds of press knife assembly are not yet enough to meet more complicated requirement from clients. Furthermore, upon punching, a working side of the machine must be determined by a specific punching requirement, which is very inconvenient.

SUMMARY OF THE INVENTION

In view of the above-described problems, it is one objective of the invention to provide a punching bookbinding machine having capacity of adjusting punching amount, pass, and pitch of holes.

To achieve the above objectives, in accordance with one embodiment of the invention, there is provided a combined punching bookbinding machine having capacity of adjusting punching amount, pass, and pitch of holes, the combined punching bookbinding machine comprising a worktable and an electric motor disposed fixedly thereon, wherein a left changeover panel and a right changeover panel are symmetrically disposed on the worktable, the axis of the left changeover panel and the axis of the right changeover panel are connected with a spindle of the machine, each end of the spindle being connected with the worktable via a spindle flange; a slotted disc and a rocker arm of a swing arm are disposed at the outside of the left changeover panel, and a transposition gear disc is disposed at the outside of the right changeover panel; the slotted disc comprises a gap at the edge and a circumferential changeover slot at the side facing the left changeover panel; the center of the slotted disc is connected fixedly with the spindle; a punching slot is disposed on the rocker arm at the side facing the left changeover panel and has two ports harmonized aligned each with one of two ports of the changeover slot, when the four ports cooperate, a closed circular groove forms; an end of the rocker arm is connected with the worktable via a rocker arm flange, and the other end is connected with an end of a push-pull rod of a transmission arm; the other end of the push-pull rod is connected flexibly with an end of a rocker; the other end of the rocker is fixed with the worktable by a hinge connection; a transmission slot is disposed at a side of the rocker and harmonizes with a pin of a curved rod; the curved rod is connected with a pto shaft of the electric motor;

Between 3 and 6 groups of press knife assembly are disposed between the left changeover panel and the right changeover panel uniformly with the axis of the left changeover panel and the axis of the right changeover panel as center; a locating slot and a slider guide slot are disposed on the left changeover panel and the right changeover panel, respectively; the quantity of the locating slot and the quantity of the slider guide slot are the same as that of the press knife assembly; a slider of the press knife assembly harmonizes with the slider guide slot; and a bottom locating slot is parallel to the worktable; and the press knife assembly comprises a knife-pressing axis, each end of the knife-pressing axis comprising a fixed cam; the fixed cam harmonizes with the slider fixed on both ends of a knife-pressing frame; a knife-withdrawing frame is fixed at the outside of the knife-pressing frame; a knife-pressing slot which is the same in quantity as a press knife is disposed on the knife-pressing frame, and a knife-withdrawing slot which is the same in quantity as the press knife is disposed on the knife-withdrawing frame; a knife-pressing sheet which is the same in quantity as the press knife is disposed on the knife-pressing frame and knife-withdrawing frame by inserting the knife-pressing slot and the knife-withdrawing slot; the press knife, the knife-pressing sheet, the knife-pressing slot, and the knife-withdrawing slot cooperate with each other in position; a knife-installing slot is disposed under the knife-pressing frame, and the press knife is installed flexibly on the knife-pressing frame via the knife-installing slot; a swing arm is disposed between the left changeover panel and the slotted disc with the axis of the left changeover panel as center, and the number of the swing arm is the same as that of the press knife assembly; an end of the swing arm is connected fixedly with the axis end of the knife-pressing axis, and at the other end disposed are the rocker arm and a rolling pin which harmonizes with the punching slot and the changeover slot.

In a class of this embodiment, a transposition gear is disposed on the transposition gear disc and connected with a handle.

In a class of this embodiment, a transposition gear is disposed on the transposition gear disc and connected with a pto shaft of the electric motor.

In a class of this embodiment, a locating pin is disposed on the worktable and harmonizes with the locating slot.

Advantages of the invention are summarized as below: by driving the left changeover panel and the right changeover panel, the press knife assembly can be combined as needed.

Meanwhile, the quantity of the press knife is regulated by knife-pressing sheet, and thereby the punching amount, pass, and pitch of holes can be adjusted.

BRIEF DESCRIPTION OF THE DRAWINGS

The invention is described hereinbelow with reference to accompanying drawings, in which.

DETAILED DESCRIPTION OF THE EMBODIMENTS

For further illustrating the invention, embodiments detailing a combined punching bookbinding machine having capacity of adjusting punching amount, pass, and pitch of holes are described below. It should be noted that the following examples are intended to describe and not to limit the invention.

Figure 1:
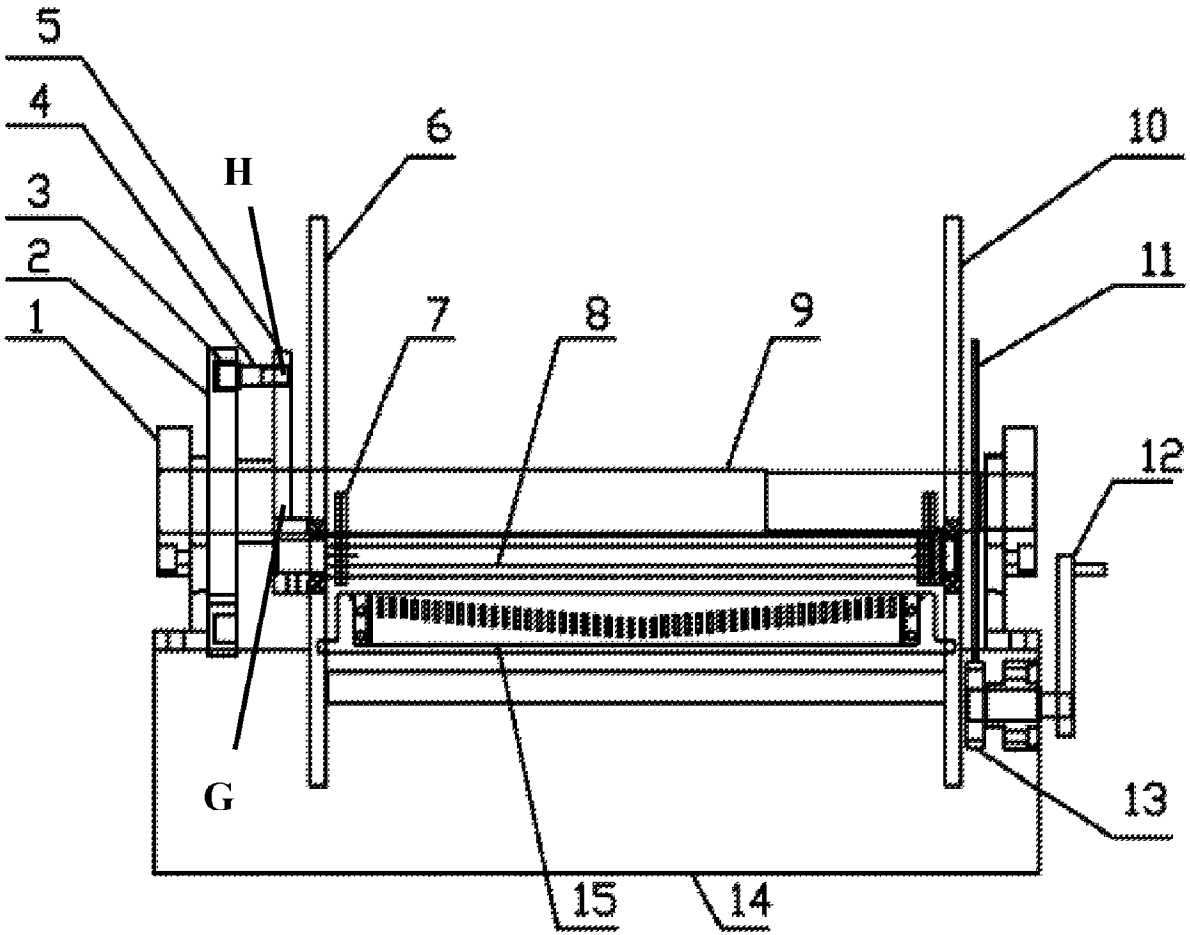
FIG. 1 is a front view of a combined punching bookbinding machine according to one embodiment of the invention.

As shown in FIG. 1, a combined punching bookbinding machine comprises a worktable 14 and an electric motor disposed fixedly thereon. A left changeover panel 6 and a right changeover panel 10 are symmetrically disposed on the worktable 14, and the axis of the left changeover panel 6 and the axis of the right changeover panel 10 are connected with a spindle 9, each end of the spindle 9 being connected with the worktable 14 via a spindle flange 1. A slotted disc 2 and a rocker arm 23 of a swing arm 5 are disposed at the outside of the left changeover panel 6, and a transposition gear disc 11 is disposed at the outside of the right changeover panel 10. A press knife assembly 15 is disposed between the left changeover panel 6 and the right changeover panel 10.

Figure 2:
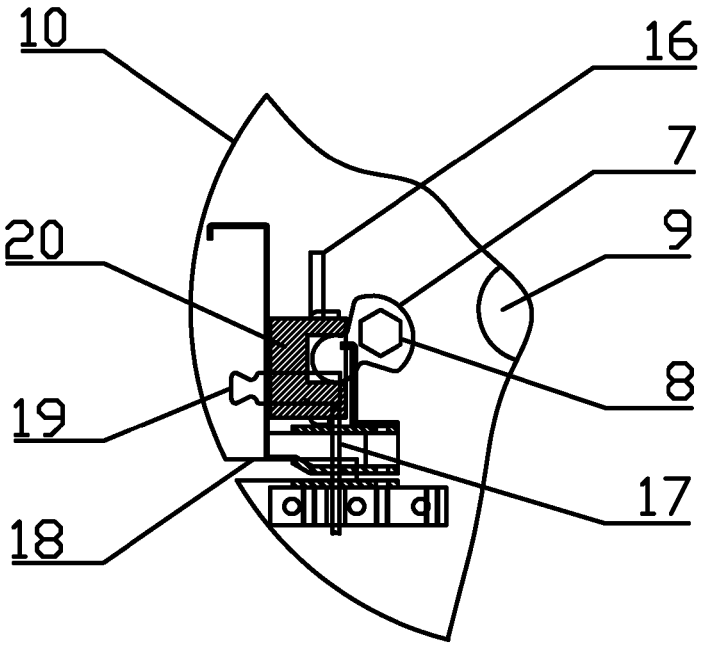
FIG. 2 is a schematic diagram of the press knife assembly as shown in FIG. 1 according to one embodiment of the invention.

As shown in FIG. 2, the press knife assembly 15 comprises a knife-pressing axis 8, each end of the knife-pressing axis 8 comprising a fixed cam 7. The fixed cam 7 harmonizes with a slider 20 fixed on both ends of a knife-pressing frame. A knife-withdrawing frame is fixed at the outside of the knife-pressing frame. A knife-pressing slot which is the same in quantity as a press knife 17 is disposed on the knife-pressing frame, and a knife-withdrawing slot which is the same in quantity as the press knife 17 is disposed on the knife-withdrawing frame. A knife-pressing sheet 19 which is the same in quantity as the press knife 17 is disposed on the knife-pressing frame and knife-withdrawing frame by inserting the knife-pressing slot and the knife-withdrawing slot. The press knife 17, the knife-pressing sheet 19, the knife-pressing slot, and the knife-withdrawing slot cooperate with each other in position. A knife-installing slot is disposed under the knife-pressing frame, and the press knife 17 is installed flexibly on the knife-pressing frame via the knife-installing slot. The structure of the press knife assembly 15 is fallen into the prior art, no need to describe in details. The invention focuses on a combination of a plurality of the press knife assembly.

Figure 3:
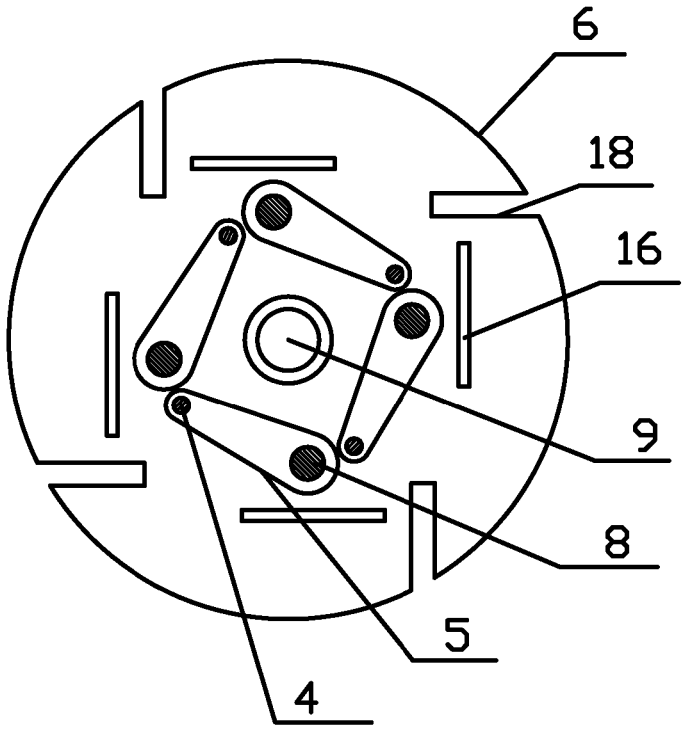
FIG. 3 is a schematic diagram of an outer surface of the left changeover panel as shown in FIG. 1 according to one embodiment of the invention.
Figure 4:
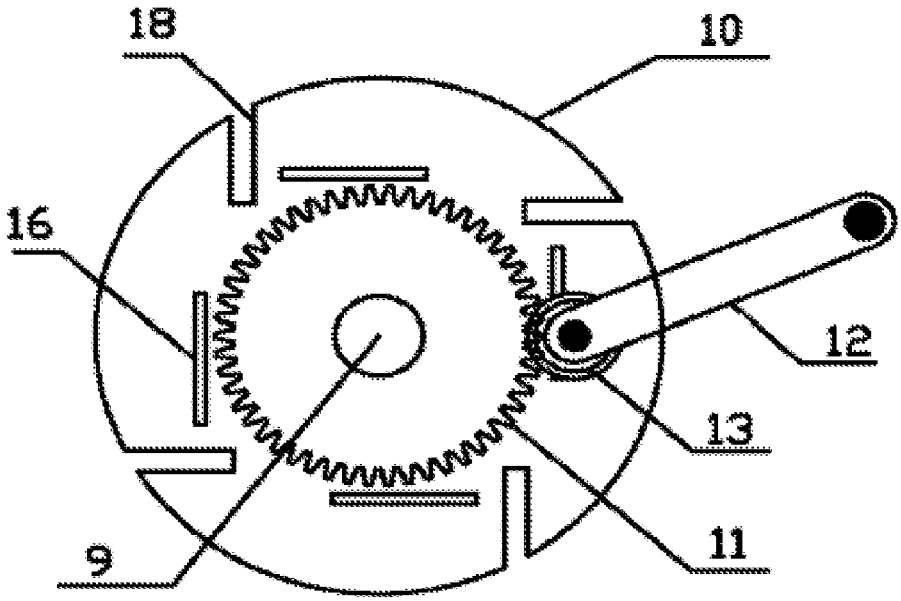
FIG. 4 is a schematic diagram of an outer surface of the right changeover panel as shown in FIG. 1 according to one embodiment of the invention.

As shown in FIGS. 3 and 4, four groups of press knife assembly 15 are disposed between the left changeover panel 6 and the right changeover panel 10 uniformly with the axis of the left changeover panel and the axis of the right changeover panel as center. Four locating slots 18 and four slider guide slots 16 are disposed on the left changeover panel 6 and the right changeover panel 10, respectively. The slider 20 of the press knife assembly 15 harmonizes with and moves back and forth in the slider guide slot 16. A bottom locating slot 18 is parallel to the worktable 14, and paper can be introduced therein. A locating pin is disposed on the worktable 14 and harmonizes with the locating slot 18. Upon turning around, the locating pin and the locating slot 18 cooperate to locate the left changeover panel 6 and the right changeover panel 10. A transposition gear disc 11 is disposed on the right changeover panel 10 and has a transposition gear 13 connected with a handle 12. Four swing arms 5 are disposed between the left changeover panel 6 and the slotted disc 2 with the axis of the left changeover panel 6 as center. An end G of the swing arm 5 is connected fixedly with the axis end of the knife-pressing axis 8, and at the other end H disposed is a rolling pin 4.

Figure 5:
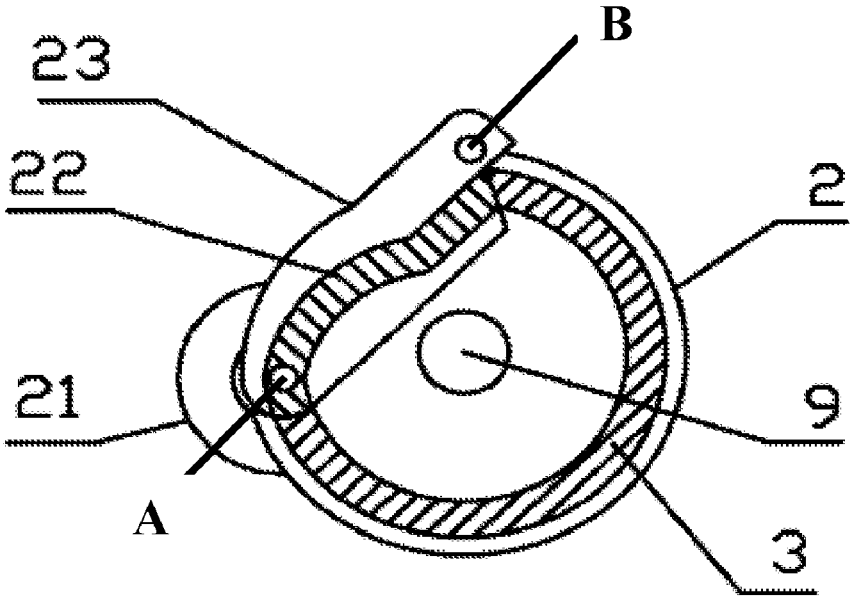
FIG. 5 is a side view of a slotted disc and a rocker arm along the axis of the spindle according to one embodiment of the invention.
Figure 6:
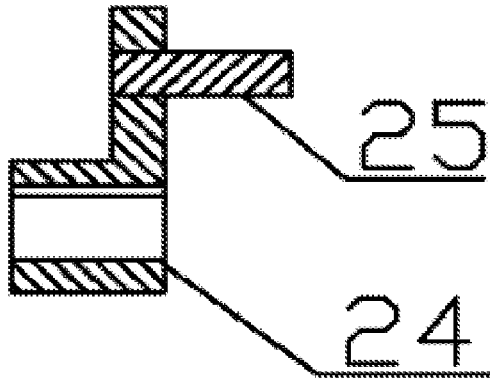
FIG. 6 is a schematic diagram of a curved rod according to one embodiment of the invention.
Figure 7:
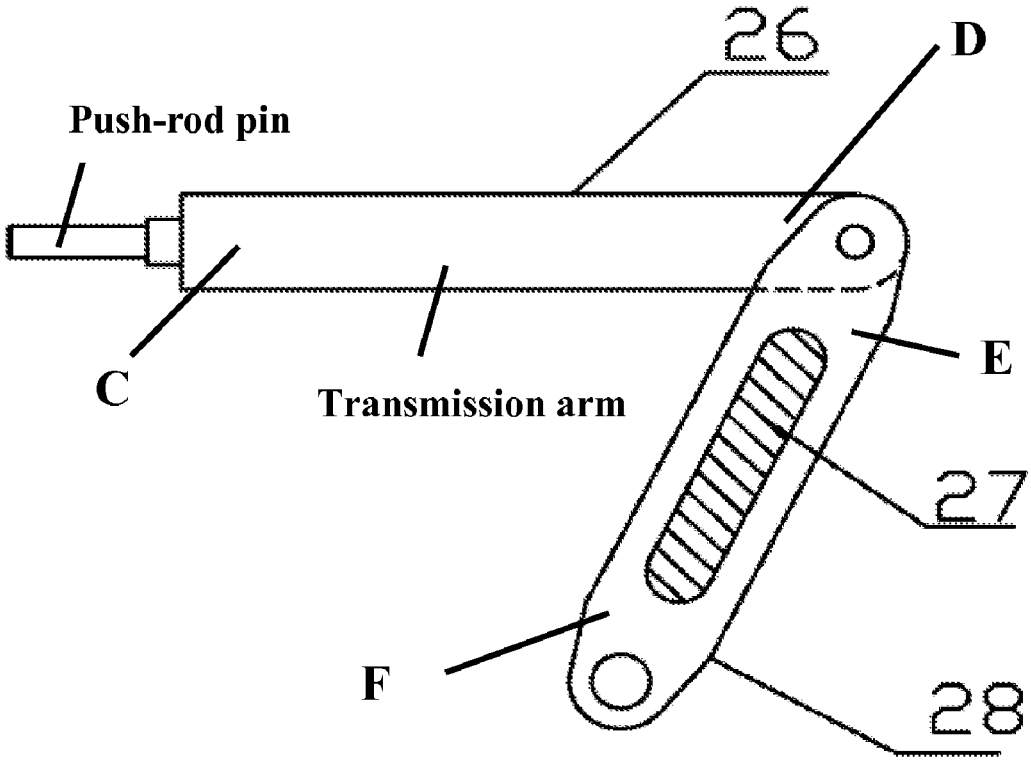
FIG. 7 is a schematic diagram of a transmission arm according to one embodiment of the invention.

As shown in FIGS. 5, 6, and 7, the slotted disc 2 comprises a gap at the edge and a circumferential changeover slot 3 at the side facing the left changeover panel 6. The center of the slotted disc 2 is connected fixedly with the spindle 9. A punching slot 22 is disposed on the rocker arm 23 at the side facing the left changeover panel 6 and has two ports A and B aligned each with one of two ports of the changeover slot 3, when the four ports cooperate, a closed circular groove forms. The rolling pin 4 moves in the punching slot 22 or the changeover slot 3. Upon the selection of the press knife assembly 15, the rolling pin 4 moves in the changeover slot 3. Upon punching, the rolling pin 4 moves in the punching slot 22. The rocker arm 23 is disposed at the end H of the swing arm 5. An end having the port A of the rocker arm 23 is connected with the worktable 14 via a rocker arm flange 21, and the other end having the port B is connected with an end C of a push-pull rod 26 of a transmission arm. The other end D of the push-pull rod 26 is connected flexibly with an end E of a rocker 28. The other end F of the rocker 28 is fixed with the worktable 14 by a hinge connection. A transmission slot 27 is disposed at a side of the rocker 28 and harmonizes with a pin 25 of a curved rod 24. The pin 25 can move in the transmission slot 27. The curved rod 24 is connected with a pto shaft of the electric motor.

By rotating the handle 12, the left changeover panel 6 and the right changeover panel 10 are drived by the transposition gear disc 11 and the transposition gear 13, and thereby the press knife assembly 15 can be combined as needed. Meanwhile, the quantity of the press knife 17 is regulated by knife-pressing sheet 19, and thereby the punching amount, pass, and pitch of holes can be adjusted. Upon work, the electric motor produces power and passes to the swing arm 5 via the curved rod 24, the rocker 28, and the push-pull rod 26, and then makes the knife-pressing axis 8 rotate. Thus, the press knife 17 moves downwards and begins to punch.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A combined punching bookbinding machine comprising a worktable and an electric motor disposed fixedly thereon, wherein (a) a left changeover panel (6) and a right changeover panel (10) are symmetrically disposed on said worktable (14), an axis of said left changeover panel (6) and an axis of said right changeover panel (10) is connected with a spindle (9), each end of said spindle (9) being connected with said worktable (14) via a spindle flange (1); a slotted disc (2) and a swing arm (5) comprising a rocker arm (23) are disposed at the outside of said left changeover panel (6), and a transposition gear disc (11) is disposed at the outside of said right changeover panel (10); said slotted disc (2) comprises a gap at the edge and a circumferential changeover slot (3) at the side facing said left changeover panel (6); the center of said slotted disc (2) is connected fixedly with said spindle (9); a punching slot (22) is disposed on said rocker arm (23) at the side facing said left changeover panel (6) and comprises two ports (A and B) aligned each with one of two ports of said changeover slot (3); an end of said rocker arm (23) is connected with said worktable (14) via a rocker arm flange (21) through one of said ports (A), and the other end is connected with a push-rod pin disposed at an end (C) of a push-pull rod (26) of a transmission arm through the other of said ports (B); the other end (D) of said push-pull rod (26) is connected flexibly with an end (E) of a rocker (28), the other end (F) of said rocker (28) being fixed with said worktable (14) by a hinge connection; a transmission slot (27) is disposed at a side of said rocker (28) and harmonizes with a pin (25) of a curved rod (24), said curved rod (24) being connected with a pto shaft of said electric motor;

(b) between 3 and 6 groups of press knife assembly (15) are disposed between said left changeover panel (6) and said right changeover panel (10) uniformly with the axis of said left changeover panel (6) and the axis of said right changeover panel (10) as center; a locating slot (18) and a slider guide slot (16) are disposed on said left changeover panel (6) and said right changeover panel (10), respectively; a slider (20) of said press knife assembly (15) harmonizes with said slider guide slot (16), and a bottom locating slot (18) is parallel to said worktable;

(c) said press knife assembly (15) comprises a knife-pressing axis (8), each end of said knife-pressing axis (8) comprising a fixed cam (7) harmonizing with said slider (20) fixed on both ends of a knife-pressing frame; a knife-withdrawing frame is fixed at the outside of said knife-pressing frame; a knife-pressing slot is disposed on said knife-pressing frame, and a knife-withdrawing slot is disposed on said knife-withdrawing frame; a knife-pressing sheet (19) is disposed on said knife-pressing frame and said knife-withdrawing frame by inserting said knife-pressing slot and said knife-withdrawing slot; said press knife (17), said knife-pressing sheet (19), said knife-pressing slot, and said knife-withdrawing slot cooperate with each other in position; a knife-installing slot is disposed under said knife-pressing frame, and said press knife (17) is installed flexibly on said knife-pressing frame via said knife-installing slot;

(d) said swing arm (5) is disposed between said left changeover panel (6) and said slotted disc (2) with the axis of the left changeover panel (6) as center, and the number of said swing arm (5) is the same as that of said press knife assembly (15); an end (G) of said swing arm (5) is connected fixedly with an axis end of said knife-pressing axis (8), and at the other end (H) disposed is a rolling pin (4) harmonizing with said punching slot (22) and said changeover slot (3);

(e) said rocker arm (23) is disposed at said end (H) of said swing arm (5);

(f) upon working of the combined punching bookbinding machine, power produced by said electric motor is first transmitted to said curved rod (24) to drive said pin (25) to move in said transmission slot (27), thereby moving said rocker (28);

(g) when said rocker (28) moves, said end (E) of said rocker (28) drives said push-pull rod (26) to move;

(h) when said push-pull rod (26) moves, push-rod pin disposed at said end (C) of said push-pull rod (26) drives said rocker arm (23) of said swing arm (5) to move; and (i) when said swing arm (5) moves, said swing arm (5) drives said knife-pressing axis (8) to move for punching.

2. The combined punching bookbinding machine of claim 1, wherein a locating pin is disposed on said worktable (14) and is aligned with with said locating slot (18).

3. The combined punching bookbinding machine of claim 1, wherein a transposition gear (13) is disposed on said transposition gear disc (11) and connected with a handle (12).

4. The combined punching bookbinding machine of claim 1, wherein a transposition gear (13) is disposed on said transposition gear disc (11) and connected with a pto shaft of said electric motor.

* * * * *